US012637734B2

(12) United States Patent
Rubin et al.

(10) Patent No.: US 12,637,734 B2
(45) Date of Patent: May 26, 2026

(54) PROCESS FOR EXTRACTING A METAL OF INTEREST FROM A MINERAL SUBSTRATE

(71) Applicant: Cemvita Factory, Inc., Houston, TX (US)

(72) Inventors: Rachel R. Rubin, Houston, TX (US); James G. Floyd, Houston, TX (US); Marina Nadal, Houston, TX (US); Marny Reakes, Houston, TX (US); Jesse Colangelo-Lillis, Houston, TX (US); Cansu Floyd, Houston, TX (US)

(73) Assignee: CEMVITA FACTORY, INC., Houston, TX (US)

( * ) Notice: Subject to any disclaimer, the term of this patent is extended or adjusted under 35 U.S.C. 154(b) by 448 days.

(21) Appl. No.: 18/333,008

(22) Filed: Jun. 12, 2023

(65) Prior Publication Data

US 2023/0399717 A1 Dec. 14, 2023

Related U.S. Application Data

(60) Provisional application No. 63/381,174, filed on Oct. 27, 2022, provisional application No. 63/366,336, filed on Jun. 14, 2022.

(51) Int. Cl.

| | |
|---|---|
| ***C22B 3/16*** | (2006.01) |
| ***C22B 3/44*** | (2006.01) |
| ***C22B 26/12*** | (2006.01) |
| ***C22B 26/22*** | (2006.01) |

(52) U.S. Cl.

CPC ..... *C22B 3/16* (2013.01); *C22B 3/44* (2013.01); *C22B 26/12* (2013.01); *C22B 26/22* (2013.01)

(58) Field of Classification Search

CPC .. C22B 3/16; C22B 3/44; C22B 26/12; C22B 26/22; C22B 11/04; C22B 3/18; C12N 1/14; C12N 1/20; C12P 3/00; C12P 7/46; Y02P 10/20

See application file for complete search history.

(56) References Cited

FOREIGN PATENT DOCUMENTS

| | | |
|---|---|---|
| CN | 1958815 | 5/2007 |
| CN | 113981218 | 1/2022 |
| DE | 2567008 | 7/1977 |

OTHER PUBLICATIONS

Rezza et al. "Extraction of lithium from spodumene by bioleaching"; Letters in Applied Microbiology, 1997, pp. 172-176 (Year: 1997).*

Lobos et al., "Tolerance of three fungal species to lithium and cobalt: Implications for bioleaching of spent rechargeable Li-ion batteries", Journal of Applied Microbiology, 2020, pp. 743-755 (Year: 2020).*

(Continued)

*Primary Examiner* — Adil A. Siddiqui

(74) *Attorney, Agent, or Firm* — Peacock Law P.C.; Deborah A. Peacock; Marco H. Santamaria

(57) ABSTRACT

A method for extracting a metal of interest from a mineral substrate comprising: 1) providing a mineral substrate containing a metal of interest, 2) contacting the mineral substrate with a leaching medium comprising a pH reducing microorganism and/or an acid or proton produced by a pH reducing microorganism, and 3) recovering a leachate comprising the metal of interest.

20 Claims, 4 Drawing Sheets

(56) References Cited

OTHER PUBLICATIONS

Wan-Xia Ren, Pei-Jun Li, Yong Geng, Xiao-Jun Li; "Biological leaching of heavy metals from a contaminated soil by Aspergillus niger"; Journal of Hazardous Materials, vol. 167, Issues 1-3, 2009, pp. 164-169.

Corbett, M.K., Eksteen, J.J., Niu, XZ, et al. Interactions of phosphate solubilising microorganisms with natural rare-earth phosphate minerals: a study utilizing Western Australian monazite. Bioprocess Biosyst Eng 40, 929-942 (2017).

International Search Report and Written Opinion for PCT Application No. PCT/US2023/068283 Mailed on Oct. 4, 2023.

Reichel et al., "Lithium recovery from lithium-containing micas using sulfur oxidizing microorganisms", Minerals Engineering, 106 (2017), pp. 18 to 21.

Rezza et al., "Extraction of lithium from spodumene by bioleaching", Letters in Applied Microbiology, vol. 25, 1997, pp. 172 to 176, DOI:10.1046/j.1472-765X.1997.00199.x.

Barnett et al., "Comparison of Heterotrophic Bioleaching and Ammonium Sulfate Ion Exchange Leaching of Rare Earth Elements from a Madagascan Ion-Adsorption Clay", Minerals, vol. 8, No. 6, 2018, pp. 236 to 246, doi: 10.3390/min8060236.

Verma et al., "Metal Recovery Using Oxalate Chemistry: A Technical Review", Industrial & Engineering Chemistry Research, 2019, 58 pages 15381-15393, DOI: 10.1021/acs.iecr.9b02598.

* cited by examiner

PROCESS FOR EXTRACTING A METAL OF INTEREST FROM A MINERAL SUBSTRATE

This application claims priority to U.S. Provisional Patent Application No. 63/366,336, filed Jun. 14, 2022, and U.S. Provisional Patent Application No. 63/381,174, filed Oct. 27, 2022. The entirety of all of the aforementioned applications in incorporated herein by reference.

FIELD

The present application relates to processes for leaching metals from clays and other mineral substrates using microorganisms, as well as those microorganisms themselves and compositions comprising them.

BACKGROUND

Geological reserves of hydrocarbons as an energy source are being depleted. Further, the devastating impact of carbon dioxide production from hydrocarbon combustion in driving climate change is becoming increasingly apparent. There is an urgent need to reduce reliance on and usage of hydrocarbon fuels and transition to alternative sources of energy.

However, alternative energy sourcing alone will not be sufficient to enable this transition to occur; energy transport and storage are also challenges that must be addressed to meet current climate change goals. Growing electric vehicle (EV) demand and applications including energy storage systems (ESS) will collectively require an increase in the sourcing and utilization of battery metals and other metals such as lithium, nickel, and cobalt. For example, the global lithium market is projected to grow from USD 3.83 billion in 2021 to USD 6.62 billion in 2028. This will leave an estimated gap in production of 2 million metric tons per annum by 2030.

Techniques to extract metals from the earth have developed over thousands of years. While the mining of metal ores, and the extraction of metal therefrom, is widespread, this has a profound environmental impact. In recent years, the recognition of this impact has become increasingly accepted by the mining industry and steps have been taken to modify such processes to make them more environmentally responsible.

One alternative to conventional mining approaches is to extract metals from clays using leaching techniques. Clays are fine-grained natural sediments made up of weathered minerals and which contain varying levels of metals.

Techniques for leaching metals such as aluminium from clays have been proposed since the 1930s and 1940s. These techniques typically utilize acids, for example sulfuric acid, to facilitate extraction of the metals of interest from the clays. While these processes are relatively effective, the production of sulfuric acid is costly and energy intensive. Additionally, owing to the corrosive nature of sulfuric acid and the related challenges associated with its transport and storage, in acid leaching processes utilizing sulfuric acid, it is typically necessary to construct a plant to produce the acid and/or a specially treated tank to store it at the locality where the leaching process is conducted. Further the selective extraction of metals from clays which are present at low concentrations, such as lithium, has proven challenging and inefficient.

The use of microbial leaching of battery metals from ores has been disclosed but these disclosures are typically on a bench scale and/or are cumbersome and inefficient. For example, Reichel et al., Minerals Engineering 106 (2017), pages 18 to 21 disclose the use of sulfur oxidising microorganisms to recover lithium from mica. In the disclosed process, a coarse-grained lithium-containing greisen ore were crushed. Mica was then hand-picked and milled. The obtained milled mica comprised 13,350 ppm of lithium and only a low level of lithium was recovered. Other attempts to microbially recover specific metals from metal-rich ores are disclosed by Rezza et al., Letters in Applied Microbiology, volume 25, 1997, pages 172 to 176; and by Barnett et al., Minerals, volume 8, no. 6, 2018, pages 236 to 246; and also in Chinese Patent Publication Nos. 113981218 and 1958815 and German Patent Publication No. 2557008.

Thus, at present, no cost effective and resource efficient method for mining and processing clays and other substrates comprising battery metals such as lithium or other high value metals present at low levels in such materials exists. Therefore, there exists a need for environmentally friendly, cost effective methods for extracting metals of interest from clays and other substrates, including battery metals or other high value metals present in low levels in such materials. Demand also exists for optimisation of the extraction of such high value metals via leaching processes.

BRIEF DESCRIPTION OF THE DRAWINGS

FIG. 1 shows an XRD scan of lithium oxalate at To.

DETAILED DESCRIPTION

Figure 1:
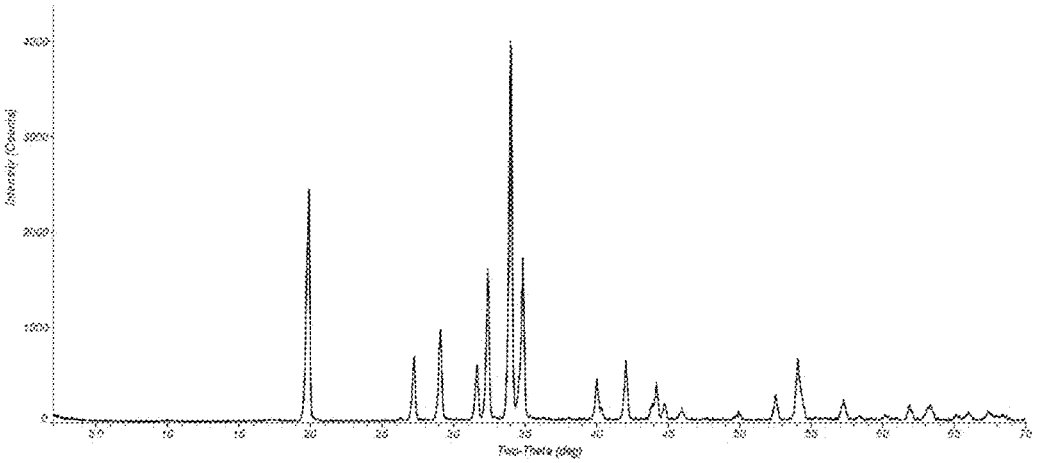

Thus, according to one aspect of the present application, there is provided a method for extracting a metal of interest from a mineral substrate comprising:

- providing a mineral substrate containing a metal of interest,
- contacting the mineral substrate with a leaching medium comprising a pH reducing microorganism and/or an acid or proton produced by a pH reducing microorganism, and recovering a leachate comprising the metal of interest; wherein:
- the metal of interest is present in the mineral substrate at a level of 5% by weight or less,
- the metal of interest is a group I or group II metal, and/or
- the microorganism produces one or more dicarboxylic acids.

One advantage provided by the processes of the present application is that the inventors unexpectedly found that the presence of one or more dicarboxylic acids, for example oxalic acid, in the leaching medium provides highly effective recovery of metals of interest from clay. Thus, in embodiments of the invention, the microorganism produces dicarboxylic acid, for example oxalic acid. This may be microbially produced or may be abiotically produced.

However, as demonstrated in the examples, the effective recovery of metals of interest from mineral substrates such as clay has been achieved using microorganisms which produce other acids. Thus, in embodiments of the invention, the microorganism may be one which produces one or more acids selected from the group consisting of citric acid, gluconic acid, sulfuric acid, oxalic acid, ascorbic acid, fumaric acid, acetic acid, propionic acid, butyric acid, isobutyric acid, succinic acid, formic acid, malonic acid, tartaric acid, itaconic acid, lactic acid. In preferred embodiments, the microorganism may be one which produces citric, gluconic and/or oxalic acid. In certain embodiments, the microorganism may be one which produces dicarboxylic acids, for example dicarboxylic acids comprising 12 or fewer carbon atoms, 10 or fewer carbon atoms, 8 or fewer carbon atoms or 6 or fewer carbon atoms. Examples of dicarboxylic acids which may be produced by the microorganism include oxalic acid, malonic acid and/or succinic acid. In some embodiments of the invention, the microorganism may produce protons.

In certain embodiments of the present application, the microorganism does not produce sulfuric acid, does not primarily produce sulfuric acid or does not produce solely sulfuric acid.

While the use of microorganisms in metal bioleaching processes has been disclosed in the literature, those disclosures highlight the shortcomings of such approaches. For example, in a paper by Verma et al., Industrial and Engineering Chemistry Research, 2019, 58 pages 15381-15393, bioleaching processes are identified as requiring longer reaction times than chemical leaching processes which makes them energy intensive. Surprisingly, as demonstrated in the examples of the present application, excellent recovery of metals from mineral substrates over significantly shorter reaction times than those disclosed in the literature have advantageously been observed using the process of the present application.

In embodiments of the invention, the acid or protons produced by the pH reducing microorganism reduces the pH of the leaching medium to pH 5 or less, pH 4 or less, or pH 3 or less.

Additionally or alternatively, the pH reducing microorganism produces one or more acid, for example one or more of the acids discussed herein, at a rate of at least 0.01 mmol/h, at least 0.02 mmol/h, at least 0.05 mmol/h, at least 0.1 mmol/h, at least 0.2 mmol/h, at least 0.05 mmol/h or at least 0.1 mmol/h. The skilled person will be familiar with methods for assessing the rate of acid production of microorganisms, e.g., using standardized colonies and growth media, assessing acid production using HPLC (high-performance liquid chromatography).

Any type of pH-reducing microorganism which is capable of promoting the leaching of metals of interest from mineral substrates may be employed in the present application. In some embodiments, the microorganism may be a fungus, a bacterium or an archaea.

In certain embodiments, the microorganism may be a heterotrophic organism (e.g., a heterotrophic bacteria or fungus), which produces one or more organic acids. Additionally or alternatively, the microorganism may not be a sulfur oxidizing microorganism.

Examples of fungi which may be employed in the present application include *Aspergilli* (e.g., *Aspergillus niger, A. brasiliensis*), strains belonging to the genera *Nectria, Rhizopus*, and strains of wood-rotting fungi, such as *Phanerochaete chrysosporium, Trametes menziesii, Fomitopsis pinicol, Schizophyllum commune, Merulius tremellosus* among others. In embodiments of the invention, the pH reducing microorganism is not an *Aspergillus*. In certain embodiments of the invention, the pH reducing microorganism is not *Aspergillus niger*.

Bacterial strains to be employed in the present application may belong to the genera *Acidithiobacillus* (e.g., *Acidithiobacillus ferrooxidans*), *Gluconobacter* (e.g., *Gluconobacter oxydans*), *Gluconacetobacter* (e.g., *Gluconacetobacter diazotrophicus*), *Bacillus* (e.g., *Bacillus licheniformis* or *Bacillus subtilis*), *Paenibacillus* (e.g., *Paenibacillus polymyxa* or *Paenibacillus mucilaginosus*), *Pseudomonas* (e.g., *Pseudomonas putida*), *Lactobacillus, Lactococcus*, or *Sulfobacillus*.

In embodiments of the invention, a plurality of microorganism strains may be present in the leaching medium. In embodiments, the plurality of microorganisms may comprise fungal and bacterial strains. In certain embodiments, the plurality of microorganisms may comprise a plurality of bacterial strains. In some embodiments, the plurality of microorganisms may comprise a plurality of fungal strains.

In embodiments in which a plurality of microorganism strains are present in the leaching medium, the plurality of microorganism strains may comprise the pH reducing microorganism and one or more additional microorganisms. In embodiments, some or all of the additional microorganisms may be pH reducing. In some embodiments, the additional microorganisms may comprise 2, 3, 4, 5, 6, 7, 8, 9, 10 or more than 10 strains. In embodiments, the additional microorganisms may comprise 2 or more strains, 2 to 5 strains, 2 to 7 strains, 2 to 10 strains, 5 or more strains, 5 to 10 strains or 7 or more strains.

The pH reducing microorganism may be prepared or treated in any way to render it useful in the process of the present application. In embodiments, the process includes the step of preconditioning the pH reducing microorganism. For example, the pH reducing microorganism may be cultured in the presence of the mineral substrate, components thereof for example the metal of interest, or other substances.

The pH reducing microorganism(s) useful in the methods of the invention may be selected or tailored to facilitate preferential leaching of one or more metals in the mineral substrate relative to one or more other metals in the mineral substrate.

The pH reducing microorganism may be native, i.e., non-engineered or may be genetically engineered.

In embodiments of the invention, the leaching medium may comprise a nutritional source, for example a carbohydrate source (e.g., a mono-, di- or polysaccharide, such as sucrose), a nitrogen source (e.g., ammonium chloride) an iron source (e.g., ferrous iron), a hydrogen source and/or a sulfur source.

The leaching medium may comprise added abiotic acid, i.e., acid not produced by a pH reducing microorganism. The added abiotic acid may be the same acid as that produced by the pH reducing microorganism or may be a different acid. In embodiments, the added abiotic acid may be one or more acids selected from the group consisting of citric acid, gluconic acid, oxalic acid, ascorbic acid, fumaric acid, acetic acid, propionic acid, butyric acid, isobutyric acid, succinic acid, malonic acid, formic acid, tartaric acid, itaconic acid, lactic acid, hydrochloric acid and/or sulfuric acid. In certain embodiments, where utilized, the added abiotic acid does not comprise sulfuric acid.

As noted above and as demonstrated in the examples, the use of dicarboxylic acid such as oxalic acid was found to yield unexpectedly positive results when assessed for the recovery of lithium and magnesium. Thus, according to a further aspect of the invention, there is provided a method for extracting a group I and/or II metal from a mineral substrate as described herein comprising:

providing a mineral substrate containing the group I and/or II metal or cation;

contacting the mineral substrate with a leaching medium comprising one or more dicarboxylic acids; and recovering a leachate comprising the metal of interest.

For the avoidance of doubt, the disclosure and embodiments provided above and throughout the present disclosure in connection with the biological leaching processes of the present application apply to this aspect of the invention, and vice versa.

In this aspect of the invention, the or each dicarboxylic acid may be produced by a pH reducing microorganism as disclosed herein or may be abiotically produced.

In certain embodiments, the dicarboxylic acid/s may comprise 12 or fewer carbon atoms, 10 or fewer carbon atoms, 8 or fewer carbon atoms or 6 or fewer carbon atoms. Examples of such dicarboxylic acids which may be employed include oxalic acid, malonic acid and/or succinic acid. Oxalic acid is particularly preferred.

As demonstrated in the accompanying examples, the processes of the present application advantageously enable high value metals of interest present in low amounts in a mineral substrate to be efficiently and selectively recovered from that substrate. In embodiments of all aspects of the invention, the metal of interest is present in the mineral substrate at a level of about 5% or less by weight. However, in embodiments, the metal of interest may be present in the mineral substrate at lower levels, for example at a level of about 4% or less, about 3% or less, about 2% or less, or about 1% or less.

In certain embodiments, the metal of interest may be present in the mineral substrate at a level of 10000 ppm or less, 5000 ppm or less, at a level of 2000 ppm or less, at a level of 1000 ppm or less, 500 ppm or less, 200 ppm or less, 100 ppm or less or 50 ppm or less. Additionally or alternatively, the metal of interest may be present in the mineral substrate at a level of at least 1 ppm, at least 2 ppm, at least 5 ppm, at least 10 ppm, at least 20 ppm, at least 50 ppm, or at least 100 ppm.

An additional advantage of the methods of the present application is that they are widely applicable and can be used to recover different metals of interest; in embodiments of the invention, the metal of interest may be lithium, nickel, cobalt, silver, boron, calcium, magnesium, sodium, potassium, titanium, manganese, vanadium, cesium, barium, radium, rhodium, beryllium, or strontium. In embodiments, the metal of interest is lithium. In some embodiments, the metal of interest is nickel. In certain embodiments, the metal is not uranium and/or a rare earth metal.

In embodiments of the invention, the metal of interest may be a group I or group II metal, for example lithium, calcium, magnesium, sodium, potassium, rhodium, beryllium, or strontium.

The metal of interest may be present in the mineral substrate and/or in the recovered leachate (i.e., the leachate recovered in step 3) of the processes of the invention) in any form. For example, the metal of interest may be present in the mineral substrate and/or be in the recovered leachate in elemental form. In embodiments, the metal of interest may be present in the mineral substrate and/or be in the recovered leachate in ionic form, for example as a cation. Additionally or alternatively, the metal of interest may be present in the mineral substrate and/or be in the recovered leachate in the form of an oxide, a salt, a complex, a conjugate or in any other form. In embodiments, the metal of interest may be dissolved in the recovered leachate.

In embodiments of the invention, the metal of interest may be in the recovered leachate in the form of a precipitate.

In embodiments in which the metal of interest is in the recovered leachate in the form of a precipitate, the method of the invention may additionally comprise the step of analyzing the composition of the precipitate.

An additional advantage of the methods of the present application is they permit the selective recovery of the metal or metals of interest from the mineral substrate. In conventional metal leaching processes utilizing sulfuric acid, metals are leached indiscriminately from mineral substrates, typically in dissolved form, requiring costly downstream processes, e.g., crystallization and precipitation steps, to separate out the metal/s of interest from undesirable components. Thus, in embodiments of the invention, the content of the metal of interest in the recovered leachate (as a weight percentage of all metal comprised in the recovered leachate) is at least about 20%, at least about 30%, at least about 40%, at least about 50%, at least about 70%, at least about 80%, at least about 90% or at least about 95%. In certain embodiments in which the metal of interest is present in the recovered leachate in the form of a precipitate, the content of the metal of Interest present in the precipitate (as a weight percentage of all metal comprised in the leachate in solid form) is at least about 20%, at least about 30%, at least about 40%, at least about 50%, at least about 70%, at least about 80%, at least about 90% or at least about 95%.

In some embodiments, the percentage recovery of the metal of interest (i.e., the amount of the metal of interest in the leachate collected in step 3 of the processes of the present application) as a weight percentage of the metal of interest in the mineral substrate prior to being contacted with the leaching medium), is at least 10% greater, at least 20% greater, at least 30% greater, at least 40% greater or at least 50% greater than the percentage recovery of any other metal in the leachate. As an illustrative example, if a metal of interest was recovered with 90% recovery, and a second metal was recovered at 40% recovery, the percentage recovery of the metal of interest would be 50% greater than that for the second metal.

In some embodiments, the percentage recovery of the metal of interest in dissolved form as a weight percentage of the metal of interest in the mineral substrate prior to being contacted with the leaching medium, is at least 10% greater, at least 20% greater, at least 30% greater, at least 40% greater or at least 50% greater than the percentage recovery of any other metal in dissolved form in the leachate.

Additionally, or alternatively, the recovered leachate may not comprise all of the metals present in the mineral substrate. In such embodiments, the recovered leachate may comprise 10 or fewer of the metals comprised in the mineral substrate, 8 or fewer of the metals comprised in the mineral substrate, 7 or fewer of the metals comprised in the mineral substrate, 6 or fewer of the metals comprised in the mineral substrate, 5 or fewer of the metals comprised in the mineral substrate, 4 or fewer of the metals comprised in the mineral substrate, 3 or fewer of the metals comprised in the mineral substrate, or 2 or fewer of the metals comprised in the mineral substrate. In certain embodiments, the recovered leachate comprises calcium and/or magnesium in amounts of 10 wt % or less, 5 wt % or less, 2 wt % or less or 1 wt % or less. In certain embodiments, the recovered leachate comprises calcium and/or magnesium in dissolved form in amounts of 10 wt % or less, 5 wt % or less, 2 wt % or less or 1 wt % or less.

Advantageously, and as demonstrated in the examples which follow, the processes of the invention permit high recovery of metal of interest from mineral substrates. Thus, in embodiments of the invention, the recovered leachate comprises at least about 20%, at least about 30%, at least about 40%, at least about 50%, at least about 60%, at least about 70%, at least about 80% or at least about 90% of the metal of interest present in the mineral substrate prior to being contacted with the leaching medium (i.e. the percentage recovery). In preferred embodiments, the recovered leachate comprises at least about 80% of the metal of interest present in the mineral substrate prior to being contacted with the leaching medium. In some embodiments, the recovered leachate comprises at least about 90% of the metal of interest present in the mineral substrate prior to being contacted with the leaching medium.

One additional benefit of the methods of the present application, as demonstrated in the accompanying examples, is that it permits the extraction and recovery of multiple metals of interest from a mineral substrate. Thus, in embodiments of the invention, the mineral substrate comprises a first metal of interest and one or more additional metals of interest, and the recovered leachate comprises the first metal of interest and one or more additional metals of interest.

In such embodiments, the first metal of interest but not the one or more additional metals of interest may be present in the mineral substrate at a level of 5% by weight or less and/or be a group I or II metal. Alternatively, the first metal of interest and the one or more additional metals of interest may collectively be present in the mineral substrate at a level of 5% by weight or less and/or all be group I and/or group II metals.

In embodiments of the invention, there may be 1, 2, 3, 4, 5 or more than 5 additional metals of interest present in the mineral substrate and/or in the recovered leachate.

The versatility of the processes of the present application permits their use with a wide range of mineral substrates. As used herein, the term "mineral substrate" is used to encompass materials comprising the metal of interest. In embodiments, the mineral substrate may be solid, for example it may be a sedimentary material such as clay, a solid precipitate, a weathered rock, or a hard rock (i.e., a rock which is not a clay). The solid mineral substrate may be in bulk form or in particulate or comminuted form. In some embodiments, the mineral substrate may be a liquid (including a liquid medium containing particulate material), for example a leachate, brine, pregnant liquor solution, mining effluent or wastewater.

In embodiments of the invention, in which the mineral substrate is a clay, the clay may be kaolinite, laterite, montmorillonite-smectite, illite, chlorite, smectite, hectorite, vermiculite, talc, pyrophyllite, varve or the like.

In embodiments of the invention in which the mineral substrate is a hard rock, this may be spodumene, goethite, hematite, or the like. In some embodiments, the mineral substrate is not a hard rock. In certain embodiments, the mineral substrate is not a mica, zinnwaldite and/or a spodumene.

In embodiments, the mineral substrate may be naturally occurring.

An advantage of the processes of the present application is that they permit the efficient extraction of metal of interest from mineral substrates such as clays and weathered rocks. Typically, such substrates comprise lower levels of metal of interest than hard rock ores selected for extraction processes owing to high content of such metals, thus making clays less attractive for metal extraction processes. However, as is demonstrated in the examples which follow, the processes of the present application permit high levels of extraction of metal of interest from clays. As explained above, the leaching medium may comprise a pH reducing microorganism and/or acid or protons produced by a pH reducing microorganism. Additionally or alternatively, the leaching medium may comprise a dicarboxylic acid which is abiotically produced. In embodiments in which the leaching medium comprises the pH reducing microorganism, the pH reducing effect of the microorganism is realized in situ in the leaching medium without separate acid production/storage apparatus needing to be set up at the location where the leaching process is being conducted.

In certain embodiments, the leaching medium may comprise acid or protons produced by a pH reducing microorganism. In such embodiments, the leaching medium may additionally comprise the microorganism which produced said acid or protons. In alternative embodiments, the leaching medium may not comprise the microorganism which produced said acid or protons, i.e., the leaching process is 'cell free'. Such cell free embodiments are advantageous over the prior art because, although the step of collecting acid/protons from a pH reducing microorganism may be required, the production of such acid/protons will generally be more energy efficient than producing sulfuric acid, utilized in conventional leaching processes. Further, acids produced by microorganisms will generally be less corrosive than concentrated sulfuric acid used in conventional leaching processes and thus are more easily and cost-effectively stored and transported.

The leaching medium may have any composition provided that it permits effective contact between itself and the mineral substrate. In embodiments of the invention, the leaching medium may be aqueous.

In certain embodiments, the leaching medium does not comprise and/or is not contacted with a cathode and/or cathode materials such as $LiCo_2$, $LiNi_xCo_{1-x}O_2$, $LiNi_{0.33}Mn_{0.33}Co_{0.33}O_2$ and/or $LiFePO_4$.

The inventors, having identified that dicarboxylic acids perform exceptionally well at leaching group I and/or II metals from mineral substrates, as demonstrated in the examples, noted that the leached metals may be present in the leachate in the form of metal dicarboxylates. Thus, in embodiments, the metal in the leachate recovered in step 3) of the processes of the invention may be a metal dicarboxylate.

Investigations were made regarding the onward processing of the obtained metal dicarboxylates, including the conversion of the obtained metal dicarboxylates into carbonates. It was unexpectedly found that the metal dicarboxylates could be conveniently converted into metal carbonates via a heat treatment step or through reaction with alkali metal carbonates. Thus, in embodiments, the processes of the invention comprise the step of 4) converting the recovered metal dicarboxylate to metal carbonate. In such embodiments, conversion of the recovered metal dicarboxylate to metal carbonate may be achieved through heat treatment.

Additionally, according to a further aspect of the invention, there is provided a process of converting a metal dicarboxylate to a metal carbonate comprising heat treating the metal dicarboxylate to convert the metal dicarboxylate to a metal carbonate.

In embodiments in which a metal dicarboxylate is converted to a metal carbonate via heat treatment, the metal dicarboxylate may be heated to a temperature of at least about 200° C., at least about 300° C., at least about 400° C. or at least about 500° C. Additionally, or alternatively, the metal dicarboxylate may be heated for at least about 1 minute, at least about 2 minutes, at least about 3 minutes, at least about 4 minutes, at least about 5 minutes, at least about minutes, at least about 20 minutes, at least about 30 minutes or at least about 60 minutes.

An alternative approach for converting metal dicarboxylate to metal carbonate which has been developed by the inventors involves reacting the metal dicarboxylate with an alkali metal carbonate. In such embodiments, the metal comprised in the metal dicarboxylate is not the same metal as the metal comprised in the alkali metal carbonate.

Thus, according to a further aspect of the invention, there is provided a process of converting a metal dicarboxylate to a metal carbonate comprising reacting the metal dicarboxylate with an alkali metal carbonate.

Reaction of the metal dicarboxylate with the alkali metal carbonate may be achieved by providing a reaction medium comprising the metal dicarboxylate and the alkali metal carbonate to produce metal carbonate which may then be recovered from the reaction medium.

In such embodiments, the reaction medium may be aqueous. Additionally or alternatively, the alkali metal carbonate may be sodium carbonate.

In certain embodiments, the reaction of the metal dicarboxylate with the alkali metal carbonate may be carried out at a temperature of at least about 0° C., at least about 10° C., or at least about 20° C. Additionally or alternatively, the reaction of the metal dicarboxylate with the alkali metal carbonate may be carried out at a temperature of about 80° C. or less, about 70° C. or less, about 60° C. or less, about 50° C. or less or about 40° C. or less. In certain embodiments, the reaction may be carried out at room temperature.

In some embodiments, the reaction of the metal dicarboxylate with the alkali metal carbonate may be carried out for at least about 1 hour, at least about 2 hours, at least about 3 hours, at least about 6 hours, at least about 9 hours or at least about 12 hours. Additionally or alternatively, the reaction of the metal dicarboxylate with the alkali metal carbonate may be carried out for about 7 days or less, about 5 days or less, about 3 days or less, about 2 days or less or about 1 day or less.

In embodiments of the invention, the metal dicarboxylate converted to metal carbonate has a mass of at least 1 g, at least 2 g, at least 5 g, at least 10 g, at least 20 g, at least 50 g, at least 100 g, at least 200 g, at least 500 g or at least 1 kg.

In embodiments, the metal dicarboxylate which is converted to metal carbonate is an oxalate. Additionally or alternatively, the metal dicarboxylate which is converted to metal carbonate is a lithium dicarboxylate.

In all embodiments of the invention, the leaching medium may be provided in 'ready to use' form or may prepared shortly prior to operation of the process. In embodiments, the processes of the invention comprise the step of providing a composition comprising the pH reducing microorganism or acid/protons produced by such a microorganism and mixing this with a liquid to produce the leaching medium. In such embodiments, the composition may comprise one or more additional microorganisms, a nutritional source as described herein, and/or an added abiotic acid.

In certain embodiments, the processes of the invention comprise the step of mixing a dicarboxylic acid with an aqueous medium to produce the leaching medium.

Thus, according to a further aspect of the present application, there is a composition comprising a pH reducing microorganism, for example, a microorganism as disclosed herein. The composition may be an inoculum, spores, a lyophilizate, a liquid concentrate, a fungal cell, or immobilized cells or a combination thereof In embodiments, the composition may comprise additional microorganisms as disclosed herein.

In certain embodiments, the composition may be provided in the form of a kit comprising the composition and instructions to use it in a metal extraction process as disclosed herein.

The processes of the invention may be operated in a reactor or in situ. In embodiments in which the processes of the invention are operated in a reactor, the reactor may take any form, for example a countercurrent reactor, continuous stirred tank reactor (CSTR), an immobilized cell reactor (ICR), trickle bed reactor (TBR), bubble column, gas lift fermenter, static mixer, plug-flow reactor or the like.

In embodiments in which the processes of the invention are operated in situ, they may be conducted in a submerged environment or in a surface environment, for example a heap leach.

Advantageously, the processes of the present application may be conducted on an industrial scale. For example, in embodiments, the leaching medium has a volume of about 500 mL or more, about 1 liter or more, about 2 liters or more, about 5 liters or more, about 10 or more liters, about 20 or more liters, about 50 or more liters, about 100 or more liters, about 200 or more liters, about 500 or more liters, about 1,000 or more liters, about 2,000 or more liters, about 5,000 or more liters, about 10,000 or more liters, about 20,000 or more liters, about 50,000 or more liters, about 100,000 or more liters, about 200,000 or more liters or about 500,000 or more liters.

In embodiments of the invention, the process of the invention comprises the step of pre-treating the mineral substrate prior to it being contacted with the leaching medium in process step 2). For example, in embodiments of the invention, the mineral substrate may be pre-treated (e.g. by grinding, comminuting, shredding, or similar) to increase its surface area (e.g. such that the mineral substrate has an average particle size (d(90)) of 25 mm or lower, 10 mm or lower, 5 mm or lower, 2 mm or lower, 1 mm or lower, 500 μm or lower, 200 μm or lower, 100 μm or lower, 50 μm or lower, 20 μm or lower, or 10 μm or lower) and/or plasticity. However, such mechanical pre-treatment is not required; as demonstrated in the examples which follow (and unlike conventional acid leaching processes), the processes of the present application do not require mechanical processing of the mineral substrate prior to the leaching process in order to facilitate the efficient extraction of metal therefrom. Accordingly, in embodiments of the invention, the mineral substrate is not provided in crushed, ground and/or comminuted form.

In embodiments, for example in those in which the mineral substrate is a clay, the pre-treatment step may comprise washing the mineral substrate with an acid. In preferred embodiments the acid is a weak acid. The inventors have found that washing mineral substrates such as clays with a weak acid prior to the commencement of leaching processes advantageously results in the selective removal of impurities such carbonates from the mineral substrate which facilitates downstream leaching processes. The reaction between the weak acid and the carbonates results in the formation of salts which precipitate out from the acid wash and can be easily removed. Thus, in embodiments, the process comprises the step of removing precipitated carbonate.

Thus, according to a further aspect of the present application, there is provided a method for extracting a metal of interest from a mineral substrate, preferably a clay, with a weak acid, subjecting to the washed mineral substrate to an acid leaching process, and recovering a leachate comprising the metal of interest. In embodiments, the process further comprises the step of removing precipitated carbonate, e.g. prior to commencement of the acid leaching process.

In embodiments, the weak acid used to wash a mineral substrate may be an organic acid. Additionally or alternatively, the weak acid may have at least one pKa value of from about 2 to about 6. The weak acid may have at least one pKa value of from about 2.5 to about 5.5 or about 3 to about 5. In this context, "pKa value" means the hydrogen in at least one acid group has a pKa value as stated. Examples of weak acids and the associated pKa values are shown in the table below:

| Carboxylic Acid | CAS No. | pKa |
|---|---|---|
| Glycolic acid | 79-14-1 | 3.83 |
| Lactic acid | 79-33-4 | 3.86 |
| Acetic acid | 64-19-7 | 4.76 |
| Oxalic acid | 144-62-7 | 1.27, 4.28 |
| Citric acid | 77-92-9 | 3.1, 4.7, 6.4 |
| Formic acid | 64-18-6 | 3.77 |

An additional or alternative pre-treatment step may be an acid leaching step, for example a sulfuric acid leaching step, e.g., one using conventional approaches. In such embodiments, the mineral substrate which is contacted with the leaching medium in step 2) of the process of the invention may be a pregnant liquor solution (PLS) obtained from the acid leaching pre-treatment step. By performing the process of the invention following such a step, the recovery of the metal of interest from the mineral substrate is maximized. Further, this permits the selective recovery of metals of interest from the mineral substrate following acid leaching. In one such embodiment, the acid used in the acid leaching pre-treatment step is not comprised in the leaching medium used in step 2) of the process of the invention. The acid comprised in the leaching medium in step 2) of the process of the invention may be abiotically and/or microbially produced. In certain embodiments, the leaching medium used in step 2) of the process of the invention comprises a dicarboxylic acid, such as oxalic acid. As demonstrated in the examples which follow, acid leaching processes as worked conventionally, e.g., using sulfuric acid, result in the recovery of PLS containing a mixture of metals including the metal of interest and the treatment of such PLS with dicarboxylic acid results in the selective precipitation of certain, but not all, dissolved metals. If the metal of interest is one which is precipitated, then it can be conveniently removed. If the metal of interest is not one which is precipitated, then the removal of other metals from the PLS will remove impurities therefrom.

According to a further aspect of the invention, there is provided a process for purifying a pregnant liquor solution comprising a metal of interest comprising contacting the pregnant liquor solution with a dicarboxylic acid (which may be abiotically or microbially produced) to selectively precipitate metals other than the metal of interest from the PLS and removing said precipitated metals from the PLS. The PLS may be recovered from an upstream acid leaching process. In certain embodiments, the metal of interest is lithium. In embodiments of the invention, the dicarboxylic acid is oxalic acid. The dicarboxylic acid used in this aspect of the invention is preferably different from the acid used in the upstream acid leaching process.

The process of the invention may further comprise the step of processing the leachate recovered in step 3) of the process of the invention. For example, in embodiments in which the metal of interest is present in dissolved form in the recovered leachate, the process of the invention may comprise recovering the metal of interest therefrom, e.g. via precipitation, ion exchange and/or electrolysis. In alternative embodiments, in which the metal of interest is present in the form of a precipitate in the recovered leachate, the process of the invention may comprise recovering the metal of interest therefrom, e.g., by collecting the precipitate from the recovered leachate and/or filtering the precipitate from the recovered leachate.

In certain embodiments of the invention, the recovered metal of interest may be subjected to additional treatment steps, for example washing and/or roasting.

In step 2) of the processes of the invention, the mineral substrate may be contacted with the leaching medium at a pre-determined ratio. For example, the mass of the mineral substrate in the leaching medium may be at least 0.1 g, at least 0.2 g, at least 0.5 g, at least 1 g, at least 2 g, at least 5 g, at least 10 g, at least 20 g, at least 50 g, at least 100 g, at least 150 g, at least 200 g, at least 250 g, at least 300 g, at least 400 g or at least 500 g per liter of leaching medium. Additionally or alternatively, the mass of the mineral substrate in the leaching medium may be 500 g or lower 200 g or lower, 100 g or lower, 50 g or lower, 20 g or lower or 10 g or lower per liter of leaching medium.

In embodiments of the invention, for example in heap leaches, the leaching medium may be present at lower volumes than the mineral substrate. For example, the leaching medium may be provided at a volume of less than 50%, of less than 40% or less than 30% of the volume of the mineral substrate. Additionally or alternatively, the leaching medium may be provided at a volume of more than 2%, more than 5%, or more than 10% of the volume of the mineral substrate.

In certain embodiments, following step 2) of the processes of the invention, the leaching medium may be maintained in contact with the mineral substrate for a maintenance period to permit leaching of the metal of interest from the mineral substrate.

In some embodiments, the maintenance period is at least 1 hour, at least 2 hours, at least 6 hours, at least 12 hours, at least 24 hours, at least 48 hours, at least 72 hours or at least 96 hours. Additionally or alternatively, the maintenance period is 336 hours or less, 240 hours or less, 168 hours or less, 96 hours or less, 72 hours or less, 48 hours or less or 24 hours or less.

In embodiments of the invention, during the maintenance period, the leaching medium may be agitated, e.g., via stirring, agitation and/or countercurrent flow.

During the maintenance period, the temperature of the leaching medium may be controlled. For example, for some or all of the maintenance period, the temperature of the leaching medium may be at least about 10° C., at least about 15° C., at least about 20° or at least about 25° C. Additionally or alternatively, for some or all of the maintenance period, the temperature of the leaching medium may be 90° C. or lower, 70° C. or lower, 50° C. or lower, 40° C. or lower, or 30° C. or lower.

In alternative embodiments, e.g., those in which the leaching medium is cell free, for some or all of the maintenance period, the temperature of the leaching medium may be at least about 50° C., at least about 60° C., at least about 80° or at least about 90° C. Additionally or alternatively, for some or all of the maintenance period, the temperature of the leaching medium may be 150° C. or lower, 130° C. or lower, 110° C. or lower, or 100° C. or lower.

The pH of the leaching medium is acidic. In some aspects of the invention, the pH of the leaching medium is less than 7. In certain embodiments, the pH is less than 6 or 5. In some embodiments, the pH of the leaching medium may be from 2 to 5.

In embodiments of the invention, the process includes the step of adjusting the pH of the leaching medium. This may be a single step, i.e., a single pH adjustment, or the pH may be adjusted periodically to maintain the pH of the leaching medium at a preferred level. The pH may be adjusted by adding the pH reducing microorganism, acid/protons produced by that microorganism, a nutritional source, abiotic acid or alkali as needed. In embodiments in which a pH adjustment step comprising the addition of microbially produced or abiotic acid is performed, the acid may be the same or different to the acid produced by the pH reducing microorganism.

The following examples are offered by way of illustration of certain embodiments of aspects of the application herein. None of the examples should be considered limiting on the scope of the application.

EXAMPLES

Example 1—Leaching of Group I/II Metals with pH Reducing Microorganisms

Lithium bioleaching was assessed using the following pH reducing microbes: *Acidithiobacillus ferrooxydans* T (DSMZ 14882) (a producer of sulfuric acid) *Gluconobacter oxydans* B58 (DSMZ 2343) (a producer of gluconic acid) *Aspergillus niger* (ATCC 16888) (a producer of citric acid)

The ability of these microbes to leach metals from a mineral substrate, specifically a clay, was assessed. The elemental composition of the clay (a mixture comprising hectorite, smectite and illite as the metal bearing minerals and calcite, quartz and plagioclase as the host clay with a lithium content of 2325 ppm) is:

| Constituent | Percent Total |
|---|---|
| Ca | 25.7 |
| Mg | 17.2 |
| C | 16.4 |
| Al | 113 |
| K | 8.0 |
| Fe | 5.8 |
| F-ALS | 4.8 |
| Na | 3.5 |
| Sr | 2.5 |
| F | 1.8 |
| Li-ALS | 0.8 |
| Li | 0.7 |
| Ti | 0.6 |
| S | 0.3 |
| Sulfite | 0.3 |
| Ba | 0.2 |
| Mn | 0.2 |
| B | 0.1 |
| Sulfide | 0.03 |
| V | 0.03 |
| Zn | 0.02 |
| Cr | 0.01 |
| Cu | 0.01 |
| Ni | 0.01 |
| W | 0.01 |

*A. ferrooxydans* was grown to a cell density of $2\times10^8$ cells/mL in Basal Salts Media ("Medium 1") consisting of 30.3 mM ammonium sulfate, 33.2 mM magnesium sulfate heptahydrate, 29.4 mM potassium phosphate dibasic, 5 mM tetrathionate, 50 mM iron sulfate heptahydrate, and trace elements. The medium was prepared at pH 1.8.

In triplicate, 15 mL of the culture was inoculated into 85 mL of Medium 1 in 250 mL erlenmeyer flasks, producing a leaching medium having an initial cell density of $3\times10^7$ cells/mL. Two grams of clay was added to each flask for a 2% pulp density. The cultures were monitored daily for the first three days, and pH was re-adjusted using sulfuric acid to maintain pH around 2. The leaching medium was sampled at 0, 7, 14, and 26 days for pH, cell density, and lithium and elemental analysis.

*G. oxydans* was grown to a cell density of ~$10^8$ cells/mL in DSMZ media recipe 105 ("Medium 2"). In triplicate, 15 mL of the culture was inoculated into 85 mL of Medium 2 in 250 mL erlenmeyer flasks, producing a leaching medium having a cell density of $1.5\times10^7$. 2 g clay was added to each flask for a 2% pulp density. Leaches were sampled at 0, 6, 12, and 16 days for pH, cell density, and lithium and elemental analysis.

*A. niger* was grown on YPD (Yeast Peptone Dextrose) agar plates until sporulation (2 days) at 28° C. Spores were collected and suspended in sterile milliQ water to a spore density of $1.36\times10^7$ spores/mL. One mL of spore suspension was inoculated into 99 mL of medium comprising 140 g/L sucrose, 1.64 g/L ammonium chloride, 1 g/L dipotassium hydrogen phosphate, and 0.4715 g/L magnesium sulfate heptahydrate. Two g clay was added to this leaching medium for a 2% pulp density. The flasks were sampled at 0 and 6 days. Results (mean of replicates):

*A. ferrooxydans*

| Time point (days) | pH | Lithium % Recovery |
|---|---|---|
| 0 | 2.75 | 0 |
| 7 | 1.75 | 6.28 |
| 14 | 1.87 | 23.23 |
| 26 | 2.27 | 71.59 |

*G. oxydans*

| Time point (days) | pH | Lithium % Recovery |
|---|---|---|
| 0 | 6.8 | 0 |
| 6 | 3.35 | 33.67 |

-continued

| Time point (days) | pH | Lithium % Recovery |
|---|---|---|
| 12 | 3.68 | 92.22 |
| 16 | 3.53 | 96.79 |

*B. niger*

| Time point (days) | pH | Lithium % Recovery |
|---|---|---|
| 6 | 4.10 | 14.97 |

Example 2—Leaching of Metals with Oxalic Acid

Abiotic experiments were set up in duplicate to determine the effect of organic acids produced by microorganisms on leaching group I/II metals from the clays. The organic acids oxalic, citric, and gluconic acids were prepared in 25 g/L and 50 g/L concentrations, and 100 mL of these solutions were added to 150 mL Erlenmeyer Flasks. Following this, the flasks were agitated at 150 rpm and placed in either a 30° C. incubator or placed on a hotplate set to 90° C. These reactions were then incubated under these conditions for T=3 hr. At T=3 hr the agitation ended, and the clay settled to the bottom of the Erlenmeyer Flasks forming a distinct supernatant (leachate). A 1 mL sample of this leachate was taken from the flasks and placed in 1 mL of 3% nitric acid to stabilize any metals in the solution. The 2 mL solution was then filtered using a syringe and a 0.22 μm syringe filter into a 15 mL Falcon Tube with 8 mL of 3% nitric acid to make a final dilution of the 1 mL of leachate 1:10 in a 3% nitric acid solution. This solution was then analyzed via ICP-OES (5900 ICP-OES, Agilent Santa Clara, CA) to detect the percent recovery of ions that were contained in the clay.

Results

TABLE 1

| 30° C. at 3 Hr | | | | | |
|---|---|---|---|---|---|
| Acid Tested | Acid/Clay Ratio | Al % Recovery | Ca % Recovery | Li % Recovery | Mg % Recovery |
| Citric Acid 50 g/L | 1:4 | 0.22 ± 0.00 | 11.25 ± 1.88 | 1.34 ± 0.01 | 0.88 ± 0.02 |
| Oxalic Acid 50 g/L | 1:4 | 4.01 ± 0.01 | 0.08 ± 0.01 | 16.59 ± 1.03 | 11.47 ± 0.94 |
| Glutamic Acid 50 g/L | 1:4 | 0.00 ± 0.00 | 0.53 ± 0.04 | 0.36 ± 0.00 | 0.08 ± 0.01 |

TABLE 2

| 90° C. at 3 hr | | | | | |
|---|---|---|---|---|---|
| Acid Tested | Acid/Clay Ratio | Al % Recovery | Ca % Recovery | Li % Recovery | Mg % Recovery |
| Citric Acid 50 g/L | 1:4 | 0.18 ± 0.02 | 1.81 ± 0.01 | 0.84 ± 0.01 | 0.59 ± 0.00 |
| Oxalic Acid 50 g/L | 1:4 | 2.10 ± 0.37 | 0.01 ± 0.00 | 40.04 ± 0.16 | 0.98 ± 0.03 |
| Glutamic Acid 50 g/L | 1:4 | 0.00 ± 0.00 | 0.97 ± 0.07 | 0.89 ± 0.04 | 0.20 ± 0.01 |

Oxalic acid had the highest lithium and magnesium recovery from the 20% slurry when compared to the other organic acids screened at 30° C. and 90° C. during T=3 Hr. This finding was surprising as, to the inventors' knowledge, oxalic acid had not previously been proposed as a leachate for recovering lithium from mineral substrates such as clays.

Example 3—Heat Treatment of Lithium Oxalate to Obtain Lithium Carbonate

Pure lithium oxalate was obtained from ChemImpex (Catalog 26493). Five grams of lithium oxalate was added to a ceramic crucible and heated to a temperature of 585° C. for 6 minutes using a RapidFire Pro-LP Electric Kiln Furnace-2200F 10 Min Melt Gold-Programmable Controller (Tabletop Furnace Company Tacoma, WA). After the heating cycle was complete, samples were analyzed using X-Ray Diffraction (XRD) with Reitveld refinement method (Bish and Howard, 1988) using MDI Jade (Newton Square, PA). X-Ray Diffraction (XRD) analyses were performed at OU School of Geosciences (Norman, OK) with a Rigaku Ultima IV instrument, using a Cu radiation source. Scans were retrieved using Bragg-Brentano method within 2-70° 2θ interval with 0.02° step size and 2-second counting time, using fixed slits. The XRD scan of lithium oxalate at To is provided as FIG. 1. An XRD scan of the material after around 1 minute is provided as FIG. 2. FIG. 3 shows the XRD scan taken following completion of the heating cycle.

The following table shows the 2-theta angles and d-spacing values corresponding to the XRD scans in FIGS. 1 to 3, and also FIG. 4, discussed below.

Figure 2:
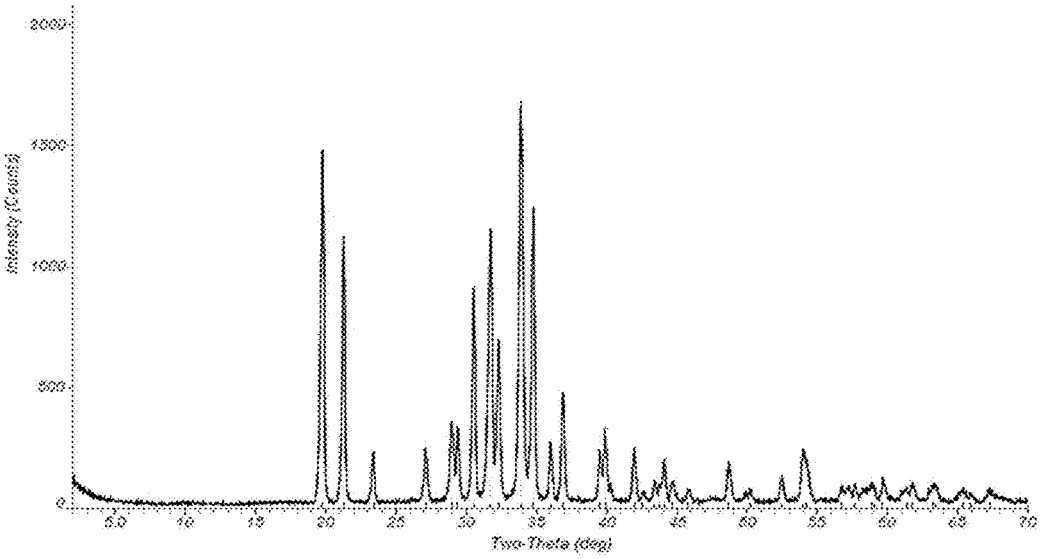
FIG. 2 shows an XRD scan of the material after around 1 minute.
Figure 3:
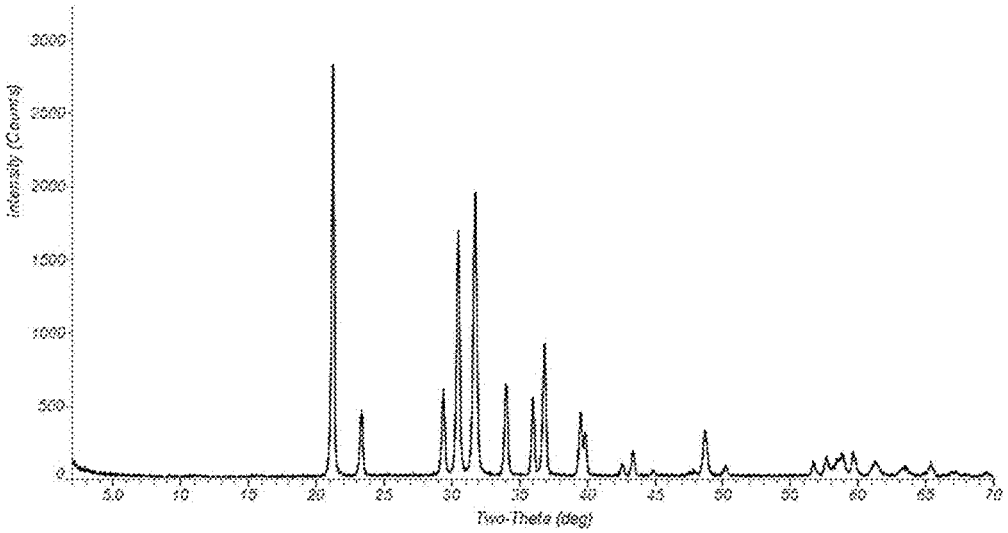
FIG. 3 shows the XRD scan taken following completion of the heating cycle.
Figure 4:
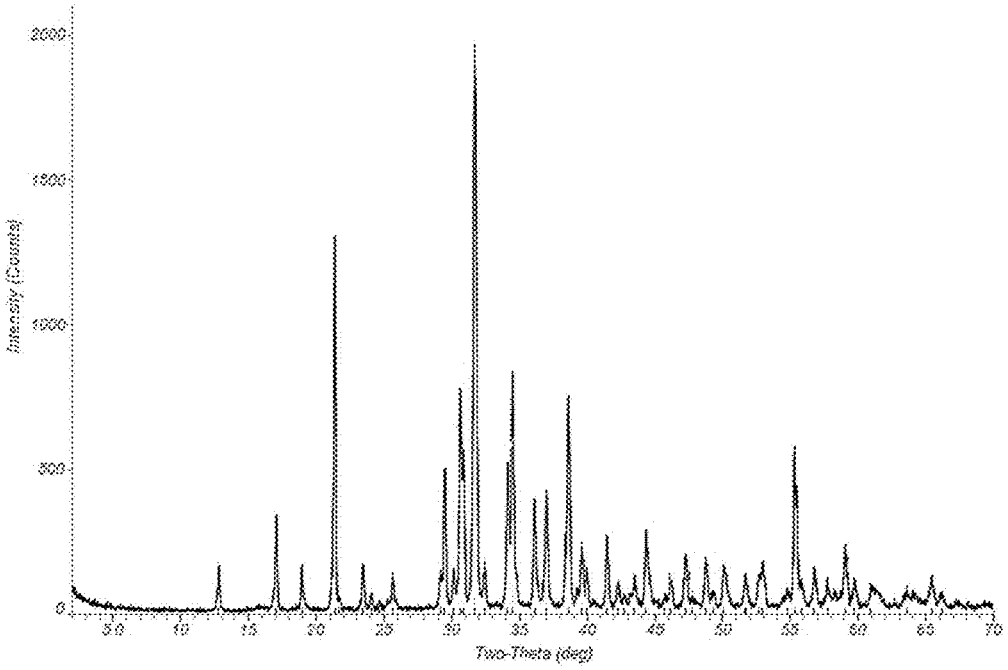
FIG. 4 shows the total conversion of lithium oxalate to lithium carbonate.

| Peak | FIG. 1 | | FIG. 2 | | FIG. 3 | | FIG. 4 | |
|---|---|---|---|---|---|---|---|---|
| # | Angle | d(Å) | Angle | d(Å) | Angle | d(Å) | Angle | d(Å) |
| 1 | 19.86 | 4.47 | 19.76 | 4.49 | 21.24 | 4.18 | 12.802 | 6.9095 |
| 2 | 26.32 | 3.38 | 21.26 | 4.18 | 23.34 | 3.81 | 17.058 | 5.1939 |
| 3 | 27.24 | 3.27 | 23.39 | 3.80 | 29.38 | 3.04 | 18.953 | 4.6785 |
| 4 | 29.06 | 3.07 | 27.1 | 3.29 | 30.48 | 2.93 | 21.361 | 4.1563 |
| 5 | 31.64 | 2.83 | 28.96 | 3.08 | 31.72 | 2.82 | 23.442 | 3.7918 |
| 6 | 32.38 | 2.76 | 29.38 | 3.04 | 34 | 2.63 | 24.095 | 3.6905 |
| 7 | 33.96 | 2.64 | 30.54 | 2.92 | 35.98 | 2.49 | 24.66 | 3.6072 |
| 8 | 34.84 | 2.57 | 31.72 | 2.82 | 36.82 | 2.44 | 25.64 | 3.4715 |
| 9 | 38.03 | 2.36 | 32.3 | 2.77 | 39.52 | 2.28 | 29.161 | 3.0599 |
| 10 | 40.02 | 2.25 | 33.9 | 2.64 | 39.82 | 2.26 | 29.496 | 3.0259 |
| 11 | 40.34 | 2.23 | 34.78 | 2.58 | 42.62 | 2.12 | 30.127 | 2.9639 |
| 12 | 42.02 | 2.15 | 36 | 2.49 | 43.36 | 2.09 | 30.64 | 2.9154 |
| 13 | 43.84 | 2.06 | 36.9 | 2.43 | 44.92 | 2.02 | 30.86 | 2.8951 |
| 14 | 44.18 | 2.05 | 39.5 | 2.28 | 48.64 | 1.87 | 31.682 | 2.822 |
| 15 | 44.72 | 2.02 | 39.9 | 2.26 | 50.22 | 1.82 | 32.42 | 2.7593 |
| 16 | 45.94 | 1.97 | 41.96 | 2.15 | 56.68 | 1.62 | 34.124 | 2.6253 |
| 17 | 49.92 | 1.83 | 42.56 | 2.12 | 57.64 | 1.6 | 34.48 | 2.5991 |
| 18 | 52.49 | 1.74 | 43.37 | 2.08 | 58.43 | 1.58 | 36.102 | 2.4859 |
| 19 | 54.06 | 1.7 | 43.7 | 2.07 | 58.84 | 1.57 | 36.965 | 2.4299 |
| 20 | 57.24 | 1.61 | 44.1 | 2.05 | 59.62 | 1.55 | 38.62 | 2.3295 |
| 21 | 58.43 | 1.58 | 44.64 | 2.03 | 61.28 | 1.51 | 39.601 | 2.274 |
| 22 | 60.17 | 1.54 | 45.82 | 1.98 | 63.26 | 1.47 | 39.947 | 2.2551 |
| 23 | 61.86 | 1.5 | 48.69 | 1.87 | 63.52 | 1.46 | 41.461 | 2.1762 |
| 24 | 63.10 | 1.47 | 50.28 | 1.81 | 65.34 | 1.43 | 42.274 | 2.1361 |
| 25 | 63.32 | 1.47 | 52.46 | 1.74 | | | 42.703 | 2.1157 |
| 26 | 65.16 | 1.43 | 53.98 | 1.70 | | | 43.478 | 2.0797 |
| 27 | 65.96 | 1.42 | 54.26 | 1.69 | | | 44.34 | 2.0413 |
| 28 | 67.32 | 1.39 | 56.73 | 1.62 | | | 46.141 | 1.9657 |
| 29 | 68.39 | 1.37 | 57.68 | 1.60 | | | 47.259 | 1.9218 |
| 30 | | | 58.83 | 1.57 | | | 47.755 | 1.903 |
| 31 | | | 59.02 | 1.56 | | | 48.741 | 1.8668 |
| 32 | | | 59.65 | 1.55 | | | 49.298 | 1.847 |
| 33 | | | 61.34 | 1.51 | | | 50.064 | 1.8205 |
| 34 | | | 61.74 | 1.50 | | | 51.646 | 1.7684 |
| 35 | | | 63.2 | 1.47 | | | 51.733 | 1.7656 |
| 36 | | | 63.4 | 1.47 | | | 52.662 | 1.7366 |
| 37 | | | 65.34 | 1.43 | | | 52.96 | 1.7276 |
| 38 | | | 65.96 | 1.42 | | | 54.762 | 1.6749 |
| 39 | | | 67.27 | 1.39 | | | 55.319 | 1.6593 |
| 40 | | | | | | | 55.779 | 1.6468 |
| 41 | | | | | | | 56.727 | 1.6215 |
| 42 | | | | | | | 57.722 | 1.5959 |
| 43 | | | | | | | 59.043 | 1.5633 |
| 44 | | | | | | | 59.721 | 1.5471 |
| 45 | | | | | | | 60.948 | 1.5189 |
| 46 | | | | | | | 63.596 | 1.4619 |
| 47 | | | | | | | 65.419 | 1.4255 |
| 48 | | | | | | | 66.156 | 1.4114 |

These figures demonstrate the total conversion of lithium oxalate to lithium carbonate.

Peak intensities from the XRD scans were used to determine the mineral composition of the sample by interfacing with databases from the International Centre for Diffraction Data.

Based on the data analysis from the XRD, it was determined that 44.2% of lithium oxalate was converted into lithium carbonate, while 55.8% of it stayed as lithium oxalate. Complete conversion of lithium oxalate to lithium carbonate was achieved when heated at 585° C. for 6 minutes. Importantly, no lithium oxalate was detected, indicating total conversion of that compound to lithium carbonate.

Example 4—Conversion of Lithium Oxalate to Lithium Carbonate Using Sodium Carbonate Pure lithium oxalate was obtained from ChemImpex (Catalog 26493) and pure sodium carbonate was obtained from Sigma-Aldrich (Catalog S7795). 1.5 gram of lithium oxalate was added to 3.5 grams of sodium carbonate in 20 mL of MilliQ water and reacted at room temperature for 12 hours. Precipitation occurred from this reaction and the solution was centrifuged at 12.1 g for 2 minutes to pellet the precipitates and decant the supernatant. The precipitates from this reaction were then analyzed using XRD and the XRD scan following the 12 hour reaction period is provided as FIG. 4.

Data from the XRD scan was then analyzed with Reitveld refinement method (Bish and Howard, 1988), using MDI Jade (Newton Square, PA). X-Ray Diffraction (XRD) analyses were performed at OU School of Geosciences (Norman, OK) with a Rigaku Ultima IV instrument, using a Cu radiation source. Scans were retrieved using Bragg-Brentano method within 2-70° 2θ interval with 0.02° step size and 2-second counting time, using fixed slits. Peak intensities from the XRD scan were used to determine the mineral composition of the sample by interfacing with databases from the International Centre for Diffraction Data. It was found that the reaction product comprised 59.9% sodium oxalate, 31.8% lithium carbonate and 8.3% impurities (believed to primarily comprise hydrogen oxalate hydrate). Importantly, no lithium oxalate was detected, indicating total conversion of that compound to lithium carbonate.

Example 5—Recovery of Metals from Clay

Smectite ore (with a lithium content of 2374 ppm) was attrition scrubbed and provided as a suspended slurry. The percent weight of the ore in its slurry form was found to be 33.2%.

A 2% solids leach by weight of the smectite ore was conducted. 7.53 g of this slurry (2.5 g total solids) was placed in 500 mL Erlenmeyer Flasks and autoclaved to sterilize the ore. Following sterilization of the ore, 117.47 g of filter sterilized DSMZ medium (100 g/L Glucose & 10 g/L Yeast Extract) was mixed with the slurry to provide a mixture with a total mass of 125 grams in the Erlenmeyer Flasks representing a 2% solids leach. Flasks were inoculated with 10% (12.5 mL) of a stationary phase *Gluconobacter oxydans* culture that had been growing for 72 hrs on DSMZ medium. These flasks were then set on a shaker set to 125 RPM in a 30° C. incubator. This experiment was set up in triplicates with abiotic chemical controls (data not shown).

Figure 5:
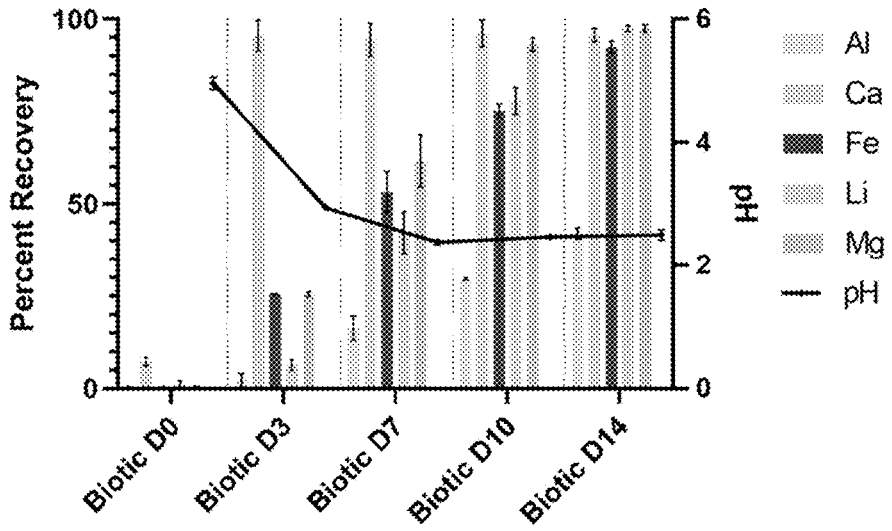
FIG. 5 shows the calculation of the percent recoveries based on the ICP-OES data generated through the experiment.

Samples were collected post-inoculation at days 0, 3, 7, 10, and 14 to monitor the leaching effects of *G. oxydans* when grown directly in the presence of this ore. A 3 mL sample was taken from the flasks through the experiment to generate cell counts, pH, ICP-OES measurements, and untargeted proteomic analyses. Percent recoveries were calculated (FIG. 5) based on the ICP-OES data generated through the experiment. The bars for each day's measurement running from right to left were representative of recovery of aluminium, calcium, iron, lithium and magnesium. As can be seen, calcium was liberated initially, followed by lithium, iron and magnesium with significant recovery of all metals except aluminium.

Example 6—Selective Extraction of Lithium from Pregnant Liquor Solution (PLS)

Smectite ore (lithium content 6954 ppm) was attrition scrubbed and provided as a suspended slurry. The percent weight of the ore in its slurry form was found to be 33.2%. The slurry was further diluted down to 20% solids using MilliQ water for the purposes of this experiment for a final slurry concentration of 20 g smectite ore in 80 g MilliQ Water/Ore Solution.

Two acid/slurry mixes were prepared. The first comprised oxalic acid, to simulate the effect of microbially produced oxalic acid. The second comprised sulphuric acid representative of conventional leaching practices. Both mixes comprised a 1:2 acid-to-ore ratio.

Figure 6:
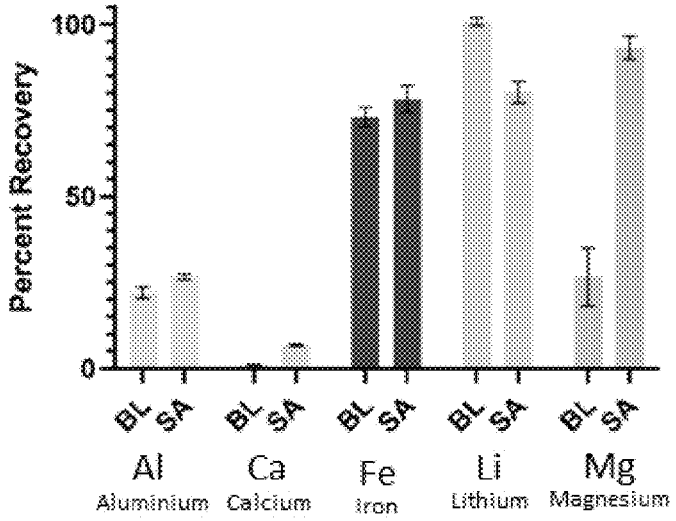
FIG. 6 shows the analysis on ICP-OES to determine percent recoveries of elements from the ore (FIG. 6—BL=oxalic acid leach, SA=sulfuric acid leach).

For the oxalic acid leach, oxalic acid crystals were obtained from Sigma-Aldrich and 10 g of dry crystals were added to the 20% slurry solution to provide a 10 g oxalic acid:20 g smectite ore (1:2) leach. For the sulfuric acid leaches, a concentrated (x>98%) sulfuric acid solution was obtained from Sigma-Aldrich. The specific gravity of this solution was found to be 1.83 and 5.46 mL (~10 g) was added to the 20% slurry solution for a 10 g Sulfuric acid:20 g smectite ore (1:2) leach. These leaches were conducted on hotplates (90° C.) and a stir bar agitated at 180 RPM. The leaches proceeded for two hours, and 2 mL of the supernatant was removed from the leaches and prepared for analysis on ICP-OES to determine percent recoveries of elements from the ore (FIG. 6—BL=oxalic acid leach, SA=sulfuric acid leach).

As can be seen, sulphuric acid resulted in the indiscriminate leaching out of metals, particularly iron, lithium and magnesium, the oxalic acid leach was more selective in favour of lithium extraction as compared to the other metals. This data demonstrates that oxalic acid and microbes which produce oxalic acid are particularly advantageous for the extraction of lithium.

Example 7—Pre-Treatment of Mineral Substrate

A clay having the following metal content was identified as suitable for acid leaching:

| Al (%) | Ca (%) | Fe (%) | K (%) | Mg (%) | Li (ppm) | Na (ppm) |
|---|---|---|---|---|---|---|
| 3.34 | 12.7 | 1.45 | 1.88 | 8.1 | 2325 | 13545 |

20 g of the clay was mixed with 5 g of acetic acid (1.045 SG) in 100 ml of total liquid volume to produce a 20% slurry. 2 replicates were set up and stirred at 500 RPM, at a temperature of 90° C. for 2 hours. The treated slurry was then filtered through a 0.22 μm filter. The composition of the filtrates was then analysed by acidification with 5% nitric acid followed by ICP-OES (Inductively Coupled Plasma Optical Emission Spectroscopy) and their composition was found to be:

| Sample Description | Al (ppm) | Ca (ppm) | Fe (ppm) | K (ppm) | Li (ppm) | Mg (ppm) | Na (ppm) | Si (ppm) |
|---|---|---|---|---|---|---|---|---|
| Acetic Acid 50 g/L Replicate 1 | 39.32 | 20015.54 | 2.23 | 156.14 | 15.19 | 212.36 | 1929.1 | 177.23 |
| Acetic Acid 50 g/L Replicate 2 | 32.96 | 14295.3 | 2.16 | 113.57 | 10.71 | 157.3 | 1441.41 | 140.45 |

Figure 7:
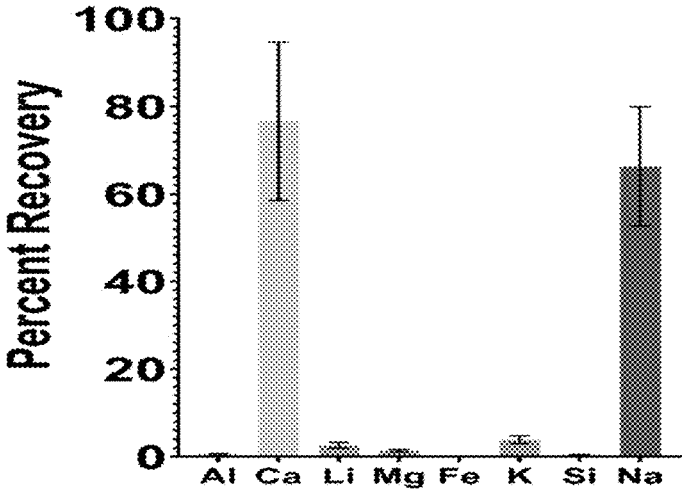
FIG. 7 is the percentages of metal extracted from the clay via the acid washing step.

The percentages of metal extracted from the clay via the acid washing step was calculated and is shown in FIG. 7.

As is apparent from that figure, the weak acid pre-treatment step resulted in the selective extraction of calcium (~80%) and sodium (~70%). In contrast, the amounts of lithium, magnesium, iron, potassium and silicon extracted from the clay were modest. The removal of carbonates, primarily calcites from mineral substrates which are to be acid leached is advantageous as this reduces acid consumption and increases leaching efficiency.

This was experimentally demonstrated. Biological leaching experiments were set up with untreated and pre-treated clay in 10% slurry concentration to compare the leaching efficiencies.

More specifically, 10 g of untreated clay was added to 100 ml of DSM105 medium, in two replicates, and *Gluconobacter oxydans* was inoculated to give a final cell count of $10^8$ cell/ml. In parallel, 2.5 g of acetic acid treated clay collected via filtration was added to 22.5 ml of DSM105 medium, in triplicates, and *Gluconobacter oxydans* was inoculated to give $10^8$ cell/ml final cell count.

All flasks were incubated at 30° C. for 21 days for the untreated clay and 12 days for the treated clay. Supernatants were taken periodically to measure pH and chemical composition after filtering through 0.22 μm syringe filters. Filtered samples were acidified with 5% HNO3 and submitted to ICP-OES (Inductively Coupled Plasma Optical Emission Spectroscopy).

The recorded compositions of the leachate obtained from the clay which was not pre-treated by weak acid washing are shown below:

| Time (day) | Al % | Ca % | Li % | Mg % | Fe % | Na % | K % |
|---|---|---|---|---|---|---|---|
| 0 | 1.18 | 1.10 | 0.18 | 0.07 | 0.71 | 18.69 | 19.96 |
| 0 | 1.10 | 1.32 | 0.21 | 0.08 | 0.79 | 18.63 | 17.23 |
| 0 | 1.31 | 1.79 | 0.28 | 0.10 | 0.38 | 21.34 | 19.98 |
| 7 | 1.48 | 63.42 | 4.68 | 3.94 | 0.51 | 62.20 | 27.30 |
| 7 | 1.40 | 47.37 | 3.45 | 2.95 | 0.32 | 59.31 | 27.64 |
| 15 | 1.85 | 71.14 | 7.05 | 5.89 | 2.46 | 71.52 | 28.78 |
| 15 | 1.61 | 60.23 | 6.18 | 4.99 | 1.45 | 69.37 | 29.07 |
| 21 | 1.93 | 56.64 | 13.19 | 10.30 | 2.74 | 67.99 | 26.86 |
| 21 | 1.76 | 57.15 | 9.66 | 8.01 | 1.91 | 75.44 | 30.86 |

The recorded composition of the leachates obtained from the pre-treated clay are shown below:

| Time (day) | Al % | Ca % | Li % | Mg % | Fe % | Na % |
|---|---|---|---|---|---|---|
| 0 | 0.69 | 4.62 | 0.16 | 0.05 | 0.06 | 24.73 |
| 0 | 0.81 | 4.07 | 0.14 | 0.05 | 0.08 | 23.68 |
| 0 | 0.73 | 4.50 | 0.17 | 0.05 | 0.07 | 26.66 |
| 5 | 3.55 | 51.86 | 29.98 | 25.16 | 9.83 | 43.82 |
| 5 | 2.16 | 34.31 | 23.37 | 19.50 | 7.25 | 26.48 |
| 5 | 4.26 | 46.67 | 38.80 | 33.19 | 11.64 | 50.14 |
| 12 | 2.61 | 33.18 | 57.36 | 55.55 | 18.00 | 45.81 |
| 12 | 3.01 | 49.45 | 81.66 | 74.66 | 24.06 | 45.40 |
| 12 | 2.07 | 33.46 | 61.95 | 58.47 | 18.20 | 37.94 |

As is apparent, pre-treatment of the clay with a weak acid pre-wash significantly increased the leaching efficiency for lithium and magnesium, with substantially higher recoveries of those metals even after a shorter leaching period.

Although this was demonstrated using a biological leaching process, a corresponding increase in leaching efficiency would be expected in an abiotic leaching process, e.g. a conventional process using strong acid (e.g. sulfuric acid).

Example 8—Purification of PLS

A clay having the following composition was biologically leached using *Gluconobacter oxydans*:

| Al (%) | Ca (%) | Fe (%) | K (%) | Mg (%) | Li (ppm) | Na (ppm) |
|---|---|---|---|---|---|---|
| 3.34 | 12.7 | 1.45 | 1.88 | 8.1 | 2325 | 13545 |

25 ml of pregnant liquor solution ("PLS") comprising 2% solids obtained from that leach was transferred to a 150 ml beaker.

A separate sample of 25 ml PLS was transferred into another 150 ml beaker and 0.25 g of oxalic acid crystals were stirred in at 200 RPM at 100° C. for 5 min via a magnetic stirrer.

1 ml of sample from each beaker were filtered through 0.22 μm. 600 μl from each sample was used to prepare 3 replicates (20011.1 each) in 10 ml volume, to determine the chemical composition. pH was measured from the remaining 400 μl.

The results obtained are shown below:

| Sample | Oxalic acid crystals added (g) | Al (ppm) | Ca (ppm) | Fe (ppm) | Li (ppm) | Mg (ppm) | Na (ppm) | Si (ppm) | pH |
|---|---|---|---|---|---|---|---|---|---|
| Direct leach PLS Replicate 1 | 0.00 | 40.00 | 1392.00 | 75.00 | 55.50 | 1282.00 | 166.00 | 114.00 | 3.15 |
| Direct leach PLS Replicate 2 | 0.00 | 40.00 | 1458.00 | 79.00 | 58.50 | 1349.50 | 176.50 | 119.50 | |
| Direct leach PLS Replicate 3 | 0.00 | 39.00 | 1439.00 | 77.50 | 57.50 | 1330.50 | 172.50 | 117.50 | |
| 10 g/L oxalic acid added PLS Replicate 1 | 0.25 | 46.50 | 13.00 | 14.50 | 71.50 | 753.00 | 201.00 | 163.00 | 2.67 |
| 10 g/L oxalic acid added PLS replicate 2 | 0.25 | 49.50 | 11.00 | 15.50 | 76.50 | 804.50 | 218.50 | 174.00 | |
| 10 g/L oxalic acid added PLS replicate 3 | 0.25 | 47.50 | 9.50 | 15.00 | 73.00 | 770.00 | 207.00 | 166.00 | |

Overall, oxalic acid addition to PLS resulted in the selective removal of almost the entire Ca (up to 99%), substantial amounts of Fe (up to 80%), and Mg (up to 41%), while keeping Li in the solution. Although these results were obtained from a PLS generated from a biological leaching process, it is anticipated that the selective removal of corresponding metals from a PLS obtained from other types of leaching processes, e.g. abiotic leaches such as those employing strong acids such as sulfuric acid.

OES samples were prepared to 1:100 dilution via mixing 0.1 ml PLS supernatant with 9.9 ml 5% HNO3 and submitted for analysis. Metal recoveries (%) were calculated based on a given element's initial concentration in the clay, acid solution volume and final concentration of the elements in solution after leaching.

Metal recoveries obtained via leaching at various conditions are summarized in the following table:

| Clay # | Acid/ Ore | % Solids | Temperature (° C.) | Time (h) | Li % Recovery | Al % Recovery | Ca % Recovery | Fe % Recovery | Mg % Recovery |
|---|---|---|---|---|---|---|---|---|---|
| 1 | 1:4 | 10 | 90 | 2 | 39.39 | 1.92 | 0.09 | 8.25 | 1.44 |
| 1 | 1:8 | 20 | 90 | 3 | 9.16 | 1.15 | 0.01 | 0.00 | 0.91 |
| 1 | 1:8 | 20 | 30 | 3 | 5.84 | 2.43 | 0.06 | 0.00 | 3.11 |
| 1 | 1:4 | 20 | 90 | 2 | 29.89 | 5.46 | 0.14 | 22.72 | 24.07 |
| 1 | 1:4 | 20 | 90 | 24 | 42.41 | 3.89 | 0.02 | 25.12 | 1.03 |
| 1 | 1:4 | 20 | 90 | 72 | 31.31 | 0.72 | 0.00 | 11.45 | 0.73 |
| 1 | 1:4 | 20 | 90 | 96 | 17.94 | 0.06 | 0.45 | 0.17 | 0.75 |
| 1 | 1:4 | 20 | 30 | 3 | 16.59 | 4.01 | 0.08 | 0.00 | 11.47 |
| 1 | 1:4 | 20 | 90 | 3 | 40.04 | 2.10 | 0.01 | 0.00 | 0.98 |
| 1 | 1:3 | 20 | 90 | 0.5 | 65.46 | 1.83 | 0.01 | 32.88 | 1.02 |
| 1 | 1:3 | 20 | 90 | 2 | 61.57 | 0.21 | 0.50 | 24.26 | 1.65 |
| 1 | 1:2 | 20 | 90 | 0.5 | 94.57 | 14.27 | 0.80 | 55.84 | 29.10 |
| 1 | 1:2 | 20 | 90 | 2 | 100.73 | 22.05 | 1.07 | 73.04 | 26.58 |
| 1 | 1:2 | 20 | 90 | 2 | 77.02 | 20.38 | 0.40 | 59.03 | 39.71 |
| 6 | 1:4 | 20 | 90 | 2 | 16.44 | 4.17 | 1.04 | 40.10 | 14.63 |
| 6 | 1:8 | 20 | 90 | 2 | 8.39 | 2.88 | 0.95 | 28.97 | 8.13 |
| 6 | 1:2 | 20 | 90 | 2 | 78.18 | 12.96 | 1.22 | 90.71 | 24.51 |
| 6 | 1:3 | 20 | 90 | 2 | 54.54 | 10.58 | 1.06 | 92.01 | 25.33 |
| 5 | 1:4 | 20 | 90 | 2 hr | 40.27 | 16.05 | 0.18 | 39.38 | 7.61 |
| 5 | 1:8 | 20 | 90 | 2 hr | 16.55 | 3.81 | 0.07 | 21.44 | 2.81 |
| 5 | 1:2 | 20 | 90 | 2 hr | 106.73 | 53.36 | 0.79 | 89.53 | 17.13 |
| 5 | 1:3 | 20 | 90 | 2 hr | 68.33 | 5.06 | 0.27 | 66.82 | 6.39 |
| 7 | 1:4 | 20 | RT | 2 hr | 41.25 | 18.11 | 0.45 | 34.88 | 16.17 |
| 7 | 1:8 | 20 | RT | 2 hr | 18.27 | 13.19 | 0.17 | 26.57 | 8.53 |
| 7 | 1:2 | 20 | 90 | 2 hr | 92.62 | 20.08 | 0.71 | 22.86 | 17.34 |
| 7 | 1:3 | 20 | 90 | 2 hr | 99.82 | 21.41 | 0.52 | 24.29 | 10.79 |
| 8 | 1:2 | 20 | 90 | 2 hr | 105.80 | 16.32 | 0.49 | 29.35 | 11.31 |
| 8 | 1:3 | 20 | 90 | 2 hr | 58.38 | 10.08 | 0.49 | 25.74 | 13.48 |

Example 9—Leaching of Lithium Using Oxalic Acid

Five clays were selected for leaching, having the following compositions:

| Clay No. | Al (%) | Ca (%) | Fe (%) | K (%) | Mg (%) | Li (ppm) | Na (ppm) |
|---|---|---|---|---|---|---|---|
| 1 | 3.34 | 12.7 | 1.45 | 1.88 | 8.1 | 2325 | 13545 |
| 5 | 3.36 | 4.33 | 1.9 | 2.54 | 9.36 | 2374 | 4952 |
| 6 | 2.64 | 1.48 | 1.94 | 5.32 | 7.36 | 6954 | 18497 |
| 7 | 2.94 | 2.1 | 1.25 | 4.43 | 6.8 | 4508 | 8001 |
| 8 | 2.19 | 2.55 | 1.17 | 5.48 | 8.68 | 6152 | 10187 |

Leaching processes were conducted at varying slurry concentrations, temperatures, and leaching times as shown in the following table. Leaching efficiencies were tested using varying amounts of oxalic acid crystals.

The amount of oxalic acid used is quantified in the table below as a weight ratio of oxalic acid crystals:clay. For example, to give a 1:4 acid/clay ratio and 10% slurry concentration, 5 g of clay in 45 g of solution (10% slurry) containing 1.25 g of oxalic acid crystals may be used.

Supernatant samples were taken at end of the leaching periods. Samples were filtered through 0.22 μm syringe-tip filters, and aliquoted for pH and ICP-OES (0.1 ml). ICP- Generally speaking, when varying conditions for a single type of clay are compared, increased temperature, and oxalic acid concentration was observed to result in increased lithium leaching efficiency. Increased leaching duration only increased leaching efficiency only up to 24 hours.

These data demonstrate that 100% lithium recovery from clays can be achieved using the processes of the invention. While these results were obtained from an abiotic leaching process, it is envisaged that corresponding recovery rates would also be achieved with biological leaching processes utilising microorganisms which produce dicarboxylic acids such as oxalic acid.

Example 10—Biological Leaching of Nickel

Three flasks of 3% ore-adapted cultures of *Gluconobacter oxydans* were gradually spun down at 600 RPM for 5 minutes and 2000 RPM for 3 minutes to separate them from the ore, without precipitating significant amounts of cells. Cells were then harvested by centrifuging at 10000 RPM for 5 minutes, followed by washing with growth media (Modified DSMZ105: 100 g/l glucose, 10 g/l yeast extract, pH 6.8). Cells were then resuspended in the exact amount of media needed for experiments (47.5 g=47.02 ml).

Six splits of 2.5 g of nickel laterite ore (OREAS 194 Standard) were transferred into 125 ml flasks and autoclaved (at dry cycle) for 20 minutes at 121° C. Modified DSM105 medium was vacuum filtered through a 0.22 μm bottle top filter in an autoclaved media bottle. 47.5 g aliquots of media for each abiotic experiment were transferred into triplicate ore containing flasks. 47.02 ml of resuspended culture were transferred to flasks containing sterile ore under a laminar flow hood. After time 0 sampling and cell counts (described below), flasks were placed on a shaker at 150 RPM in a temperature-controlled incubator set to 27° C.

1 ml samples were taken from each flask at experimental days 0, 3, 7 and 14. Flasks were weighed before and after sampling to account for evaporative loss and loss from sampling. Small untreated aliquots (200 μl) were spared from biotic reactors for biomass assessment (e.g., cell counts) using a Petroff-Hauser chamber. The remainder of the samples were filtered (0.22 μm) and 200 μl aliquots were used for pH measurements and 100 μl aliquots were diluted 1:100 in 5% nitric acid for ICP-AES.

The results observed are presented in the following table:

| Replicate | Bio | Time (days) | Cells/ml | pH | Ni recovery (%) | Fe recovery (%) | Co recovery (%) | Ca recovery (%) | Mg recovery (%) | Mn recovery (%) |
|---|---|---|---|---|---|---|---|---|---|---|
| 1 | Biotic | 0 | 2.56E+07 | 6.58 | 0.32 | 0.01 | −0.03 | 14.45 | 0.62 | 0.02 |
| 2 | Biotic | 0 | 2.21E+07 | 6.70 | 0.40 | 0.00 | 0.12 | 13.51 | 0.83 | 0.01 |
| 3 | Biotic | 0 | 1.53E+07 | 6.62 | 0.37 | 0.01 | 0.00 | 13.47 | 0.80 | 0.02 |
| 1 | Abiotic | 0 | 0.00 | 6.92 | 0.53 | 0.00 | −0.02 | 14.20 | 0.89 | 0.02 |
| 2 | Abiotic | 0 | 0.00 | 6.99 | 0.54 | 0.00 | −0.04 | 16.31 | 0.86 | 0.01 |
| 3 | Abiotic | 0 | 0.00 | 6.89 | 0.49 | 0.00 | 0.10 | 14.65 | 0.87 | 0.02 |
| 1 | Biotic | 3 | 6.13E+07 | 3.07 | 39.22 | 4.93 | 56.48 | 26.43 | 9.34 | 71.36 |
| 2 | Biotic | 3 | 6.00E+07 | 3.07 | 30.57 | 3.88 | 43.92 | 21.34 | 7.34 | 54.94 |
| 3 | Biotic | 3 | 8.80E+07 | 2.92 | 35.66 | 3.95 | 52.45 | 24.74 | 8.56 | 68.10 |
| 1 | Abiotic | 3 | 0.00 | 7.06 | 4.03 | 0.00 | 0.45 | 14.09 | 0.93 | 0.09 |
| 2 | Abiotic | 3 | 0.00 | 7.19 | 3.88 | 0.00 | 0.54 | 15.73 | 0.96 | 0.09 |
| 3 | Abiotic | 3 | 0.00 | 7.16 | 3.63 | 0.00 | 0.33 | 17.96 | 0.89 | 0.08 |
| 1 | Biotic | 7 | 2.59E+07 | 3.00 | 103.19 | 19.74 | 80.68 | 32.02 | 29.98 | 86.85 |
| 2 | Biotic | 7 | 2.50E+07 | 3.00 | 98.58 | 19.48 | 80.54 | 27.89 | 29.98 | 84.50 |
| 3 | Biotic | 7 | 2.20E+07 | 2.96 | 102.12 | 19.21 | 82.25 | 30.24 | 31.37 | 88.90 |
| 1 | Abiotic | 7 | 0.00 | 7.08 | 5.62 | 0.00 | 1.08 | 16.66 | 1.06 | 0.17 |
| 2 | Abiotic | 7 | 0.00 | 7.04 | 5.44 | 0.00 | 1.37 | 18.59 | 1.03 | 0.16 |
| 3 | Abiotic | 7 | 0.00 | 6.89 | 5.24 | 0.00 | 1.16 | 16.01 | 0.99 | 0.15 |
| 1 | Biotic | 14 | 4.34E+07 | 3.37 | 90.53 | 33.31 | 38.33 | 34.18 | 78.57 | 90.24 |
| 2 | Biotic | 14 | 1.98E+07 | 3.47 | 97.57 | 32.11 | 49.96 | 30.40 | 67.74 | 89.39 |
| 3 | Biotic | 14 | 2.83E+07 | 3.46 | 101.67 | 33.34 | 51.99 | 30.52 | 70.29 | 92.35 |
| 1 | Abiotic | 14 | 0.00 | 7.16 | 8.72 | 0.00 | 2.57 | 16.71 | 1.32 | 0.43 |
| 2 | Abiotic | 14 | 0.00 | 7.19 | 8.40 | 0.00 | 2.43 | 17.34 | 1.31 | 0.43 |
| 3 | Abiotic | 14 | 0.00 | 7.14 | 8.01 | 0.00 | 2.21 | 18.37 | 1.31 | 0.43 |

*Gluconobacter oxydans* flasks showed a drop in pH to ~3, and up to ~39% nickel was leached into solution after 3 days. By day 7, the pH remained at ~3, and 100% nickel had advantageously been selectively leached and solubilized. Magnesium, iron, manganese and cobalt were also leached into the solution albeit at lower percentages.

The above description is for the purpose of teaching the person of ordinary skill in the art how to practice the object of the present application, and it is not intended to detail all those obvious modifications and variations of it which will become apparent to the skilled worker upon reading the description. It is intended, however, that all such obvious modifications and variations be included within the scope of the present application, which is defined by the following claims. The aspects and embodiments are intended to cover the components and steps in any sequence, which is effective to meet the objectives there intended, unless the context specifically indicates the contrary.

What is claimed is:

1. A method for extracting a metal of interest from a mineral substrate comprising:

1) providing a mineral substrate containing a metal of interest, 2) contacting the mineral substrate with a leaching medium comprising a pH reducing microorganism and/or an acid or proton produced by a pH reducing microorganism, and 3) recovering a leachate comprising the metal of interest, wherein:

A) the metal of interest is present in the mineral substrate at a level of 5% by weight or less, B) the metal of interest is a group I or group II metal, and/or C) the microorganism produces one or more dicarboxylic acids which is present in the leaching medium.

2. The method of claim 1, wherein the microorganism produces oxalic acid, malonic acid and/or succinic acid.

3. The method of claim 1, wherein the leaching medium comprises the pH reducing microorganism.

4. The method of claim 1, wherein the leaching medium comprises an acid or proton produced by a pH reducing microorganism.

5. The method of claim 1, wherein the leaching medium comprises an acid or proton produced by a pH reducing microorganism, but does not comprise the pH reducing microorganism.

6. The method of claim 1, wherein the pH reducing microorganism produces citric acid, gluconic acid, sulphuric acid, oxalic acid, ascorbic acid, fumaric acid, acetic acid, propionic acid, butyric acid, isobutyric acid, succinic acid, formic acid, malonic acid, tartaric acid, itaconic acid and/or lactic acid.

7. The method of claim 1, wherein the acid or protons produced by the pH reducing microorganism reduces the pH of the leaching medium to pH 3 or less.

8. The method of claim 1, wherein the pH reducing microorganism is a bacteria or a fungus.

9. The method of claim 1, wherein the metal of interest is lithium and/or magnesium.

10. The method of claim 1, wherein the group I and/or II metal is lithium.

11. The method of claim 1, wherein the metal of interest is present in the mineral substrate at a level of 1% by weight or less.

12. The method of claim 1, wherein the metal of interest is recovered in the leachate in dissolved form.

13. The method of claim 1, wherein the mineral substrate is a clay.

14. The method of claim 1, further comprising the step of pre-treating the mineral substrate prior to being contacted with the leaching medium.

15. The method of claim 14, wherein the step of pre-treating the mineral substrate comprises washing the mineral substrate with a weak acid.

16. The process of claim 15, wherein the weak acid is oxalic acid.

17. The method of claim 1, wherein the metal of interest recovered in the leachate is post-treated.

18. The method of claim 1, wherein the metal of interest is present in the recovered leachate in the form of a metal dicarboxylate.

19. The process of claim 18, further comprising the step of converting the recovered metal dicarboxylate to metal carbonate.

20. The method of claim 19, wherein the recovered metal dicarboxylate is converted to metal carbonate by heat treatment or by reaction with alkali metal carbonate.

* * * * *